US006503434B1

(12) United States Patent
Mayer

(10) Patent No.: US 6,503,434 B1
(45) Date of Patent: Jan. 7, 2003

(54) METHOD FOR MANUFACTURING REINFORCED CONCRETE

(76) Inventor: Stanley Mayer, 2935 Byberry Rd., Hatboro, PA (US) 19040

( * ) Notice: Subject to any disclaimer, the term of this patent is extended or adjusted under 35 U.S.C. 154(b) by 0 days.

(21) Appl. No.: 09/346,797

(22) Filed: Jul. 2, 1999

Related U.S. Application Data

(60) Provisional application No. 60/017,585, filed on May 14, 1996.

(51) Int. Cl.[7] ..... E04C 5/16; E04B 1/16
(52) U.S. Cl. ..... 264/273; 264/31; 52/719
(58) Field of Search ..... 52/719; 264/273, 264/31

(56) References Cited

U.S. PATENT DOCUMENTS

| | | | | | |
|---|---|---|---|---|---|
| 1,890,757 | A | | 12/1932 | Strickler | |
| 4,096,680 | A | | 6/1978 | Ritter et al. | |
| 4,111,089 | A | * | 9/1978 | Montaruli | 83/542 |
| 4,561,804 | A | * | 12/1985 | Weatherby | 405/262 |
| 5,189,761 | A | | 3/1993 | Chisholm | |
| 5,295,285 | A | * | 3/1994 | Shely | |
| 5,544,446 | A | * | 8/1996 | Benson, Jr. | 47/45 |
| 5,699,642 | A | | 12/1997 | McDevitt, Jr. | |
| 5,879,550 | A | * | 3/1999 | Cox | 210/175.4 |

FOREIGN PATENT DOCUMENTS

| | | | |
|---|---|---|---|
| FR | 1138801 | | 9/1955 |
| FR | 1.138.801 | * | 6/1957 |

* cited by examiner

*Primary Examiner*—Christopher A. Fiorilla
(74) *Attorney, Agent, or Firm*—Jenkens & Gilchrist

(57) ABSTRACT

The present invention relates to the manufacture of reinforced concrete structures wherein plastic tie fasteners are used to secure the rebar structure within the concrete structure. Furthermore, the present invention relates to a method of securing rebar by using plastic tie fasteners.

13 Claims, 4 Drawing Sheets

Side View

Front View

Side View

Front View

Side View

METHOD FOR MANUFACTURING REINFORCED CONCRETE

This application is based on Provisional Application No. 60/017,585 filed May 14, 1996.

BACKGROUND OF THE INVENTION

1. Field of the Invention

The present invention relates to the manufacture of reinforced concrete. In particular the present invention relates to reinforced concrete wherein the rebar within the reinforced concrete is secured with a plastic tie fastener or a substantially similar device. Furthermore, the present invention relates to a method for manufacturing reinforced concrete using plastic tie fasteners or a substantially similar device. The present invention also relates to devices for securing rebar in reinforced concrete.

2. Description of the Related Art

The process of manufacturing steel reinforced concrete begins by forming a two or three dimensional grid of steel rebar around which concrete is poured. The individual lengths of rebar 10 are secured to one another to form this grid. Currently the industry standard is that the lengths of rebar are secured to one another at the grid intersections either by wrapping metal (usually steel) wire 12 around all lengths of rebar which form the grid at the intersections or by securing the grid intersections with spring steel wire clips (see FIGS. 1*a*, 1*b* and 2).

If metal wires 12 are used to prepare the grid, the free ends of the metal wire are twisted to tension the tie, securing the crossed bars in place. The free ends of the tie wire are then cut off or bent away from the concrete surface above the twist.

If the spring steel wire clips are used, the intersections are held together by the spring force of the spring steel wire clips.

If the concrete product is to be placed in a hostile environment (such as salt water, basic or acidic soil, etc.), the additional step of coating the metal tie wires or spring steel wire clips with some sort of protective coating or of using stainless steel metal tie wires must be taken.

There are a few drawbacks of the present uses of steel wire 12 and/or steel spring clips. The first drawback is the added time required by a construction worker to twist the free ends of the metal wires to tension the ties. Furthermore, the twisting of the wire fatigues the metal wire 12 at the twist site. This could cause the wire to break and allow the rebar 10 to become unsecured either prior to the pouring of concrete or even worse after the concrete has been poured. If the rebar becomes unsecured after the concrete has been poured the concrete may not have the reinforced strength that is required.

Another drawback of using metal wire ties is that the act of the construction worker attaching a machine to twist the ends of the wire tie, or the act of twisting the wire tie by hand is a time consuming task. Furthermore, the act of twisting wires requires an amount of area next to the rebar to twist the wire. Many times there are so many rebars 10 used to reinforce the concrete that there is little room between adjacent rebars to twist the steel wire 12.

Another drawback, which was alluded to above, is that the steel wires 12 or clips will rust if the concrete product is placed in a hostile environment. The rusting may weaken the overall structure and or produce unsightly stains on the structure. Rusting of the steel wire or clips cannot be completely avoided, but can be inhibited to some degree by coating the wires or clips with a protective coating. The extra coating step is costly and not always successful due to incomplete coating of the wires, having a twisted end which is difficult to completely coat, and if the end is removed or breaks off during the process an exposed end is left.

SUMMARY OF THE INVENTION

The present invention relates to the manufacture of reinforced concrete structures wherein plastic tie fasteners are used to secure the rebar structure within the concrete structure. Furthermore, the present invention relates to a method of securing rebar by using plastic tie fasteners. The plastic tie fasteners are looped about the rebar bars and tightened using a unidirectional force. The plastic tie fasteners can be looped and tightened via hand or an applicator or tensioning apparatus. The plastic tie fasteners offer the unexpected advantages of strength, flexibility, and ease of use to the reinforced concrete industry. Furthermore, the plastic tie fasteners do not rust or require rust retardant coatings. Still furthermore, the present invention prescribes a rebar securing apparatus comprising a plastic strip with a means for securing an end of said plastic strip in a looped configuration. The securing apparatus' means for securing can be a ratcheting or slip resistant receptacle. Furthermore, the means for securing can be designed to disallow the loop from becoming larger or can be designed to allow the loop to become larger without damaging the securing apparatus.

The present invention provides a multitude of advantages which include, but are not limited to being incapable of rusting and staining a concrete structure, decreasing the amount of time required to secure rebar bars, an ease of use due to a simple technique for tightening the loop of the plastic tie fastener about the rebar, requiring only one hand of a construction worker to attach the plastic tie fastener to the rebar, and decreasing construction costs.

BRIEF DESCRIPTION OF THE DRAWINGS

The objects and advantages of this invention will become apparent and more readily appreciated from the following description of the presently preferred exemplary embodiments, taken in conjunction with the accompanying drawings, of which.

DETAILED DESCRIPTION OF THE PREFERRED EXEMPLARY EMBODIMENTS

Figure 3:
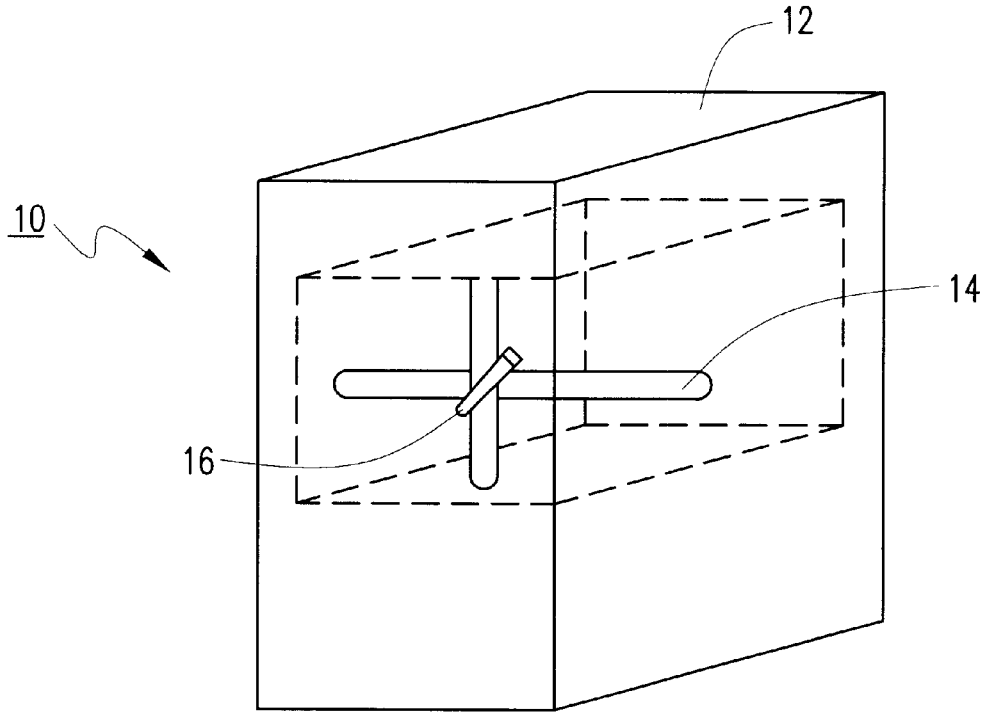
FIG. 3 depicts a three dimensional drawing of a reinforced concrete structure with a cutaway portion showing rebar secured with a plastic tie fastener.

FIG. 3 depicts an embodiment of the present reinforced concrete 14 wherein the rebar 10, which is reinforcing the concrete 14, is held together via a plastic tie fastener 16. FIG. 3 has been simplified to better depict the exemplary embodiment. Ordinarily a rebar grid, lattice or structure is created wherein a plurality of rebars 10 are attached together via a plurality of plastic tie fasteners 16. After the rebar grid, lattice, or structure is created, concrete is poured to cover the rebar structure. In many cases, wood or other material is used to mold the concrete about the rebar structure.

Figure 1A:
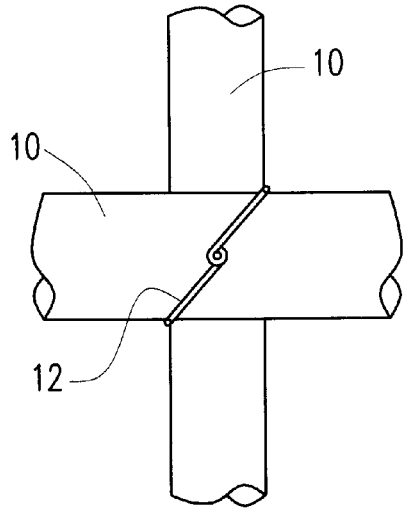
FIG. 1A (PRIOR ART)
FIGS. 1*a* and 1*b* depict a prior art technique and apparatus for securing rebar with steel wire which is twisted.
Figure 1B:
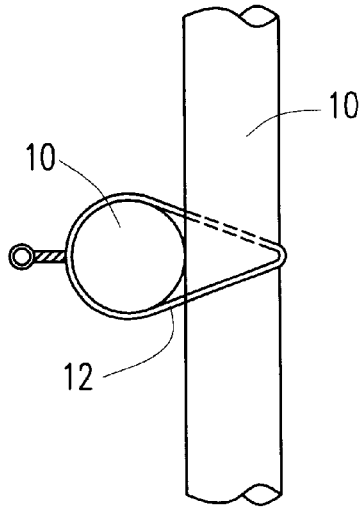
FIG. 1B (PRIOR ART)
Figure 2:
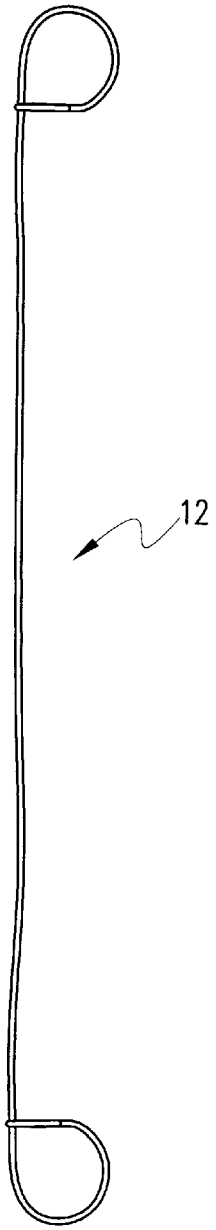
FIG. 2 depicts a prior art steel tie wire.
Figure 5:
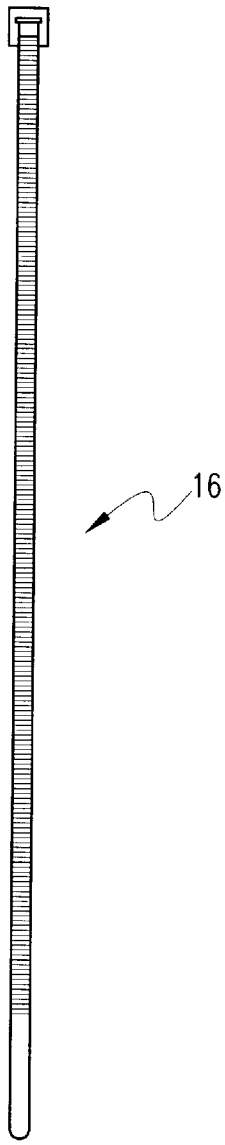
FIG. 5 depicts an exemplary plastic tie fastener for use in securing rebar bars in a reinforced concrete structure.

Referring to FIGS. 3 and 5, the plastic tie fasteners 16 that are presently commercially marketed and could be used in the present invention are sold as cable ties or wire ties and may be manufactured under such trademarks as "TIE-WRAP", "PAN-TIE", and "BAR-TY". To date, plastic tie fasteners have not been used in the rebaring step of manufacturing reinforced concrete. Furthermore, tradition has held that metal wire should be used in the rebaring of reinforced concrete process.

Figure 4A:
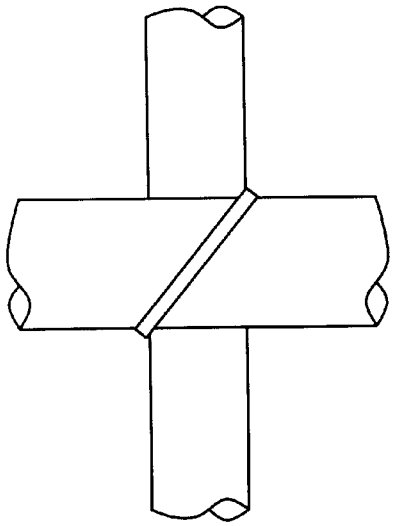
FIGS. 4*a* and 4*b* depict an exemplary plastic tie fastener securing two rebar bars that are angularly disposed.
Figure 4B:
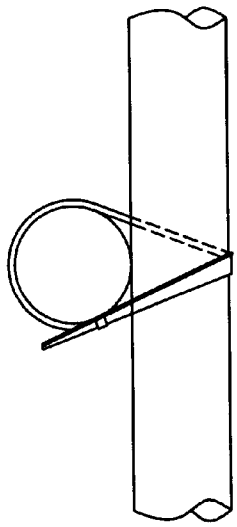

After much testing, it has been determined that plastic ties 16 can be used to hold rebar 10 together. Referring to FIGS. 3, 4*a* and 4*b*, the preferred plastic tie fasteners 16 form a loop about at least two rebars 10 and are designed to "zip" in a ratcheted manner so that the loop tightens about the rebar and cannot be easily loosened. (Note that plastic tie fasteners 16 can be designed to loosen without damage to the plastic tie fastener.) The plastic tie fasteners 16 can be applied and tightened by hand or can applied by commercially available applicators and tensioning machines not shown. The act of tightening a plastic tie fastener 16 is less complex than the act of twisting the ends of a steel wire. In fact, the act of tightening a plastic tie fastener 16 does not require a complex twisting motion, instead a simple unidirectional pull tightens the tie about the rebar 10. This unidirectional movement is especially advantageous and useful if there is limited room or area between various bars in a rebar structure. Furthermore, the act of tightening a plastic tie fastener 16 takes less time and is less likely to break than twisting the ends of a metal wire together. Thus, the operation of preparing a rebar structure can take less time using the exemplary rebarring method than when using a wire twisting method of rebarring.

Plastic tie fasteners 16 that are used in the preferred reinforced concrete and method for making reinforced concrete should be nylon because they provide both strength and flexibility and a small amount of elasticity (see FIG. 5). Experimentation has indicated that stronger plastic tie fasteners 16 may be used. Such plastic ties fasteners 16 may be manufactured by using a higher tensile strength plastic or incorporating fiber reinforcement into the plastic.

In the preferred method for manufacturing reinforced concrete 14, rebar is formed into a lattice or grid structure. Various rebar bars 10 are held together in the structure via plastic tie fasteners 16. It is understood that the rebar bars 10 do not have to be perpendicular to each other, but instead could be adjacent to each other in almost any conceivable geometric configuration with respect to each other. For example, the bars could be parallel, in a curvilinear relationship, tangential, angularly dispersed, etc.

When the plastic tie fasteners 16 are being used to hold the rebar 10 together, the plastic tie fastener 16 is first looped about the rebar bars 10 to be secured. Then the plastic tie fastener 16 is tightened by pulling one end of the tie fastener to decrease the loop size about the rebar bars. Once tightened, the plastic tie fastener may have a "free" end protruding. The free end can be easily removed. Tightening of the plastic tie fastener 16 may be done by hand or by using an applicator. Once a structure is rebarred, then concrete can be poured into a mold covering the rebar. Once the concrete sets and/or cures the mold can be removed and a reinforced concrete structure 14 results.

It is further noted that the present method of securing rebar, that is the placement and tightening of a plastic tie fastener, could be performed with one hand thereby leaving the other hand of a construction worker free. Conversely, when metal wire ties are used to secure rebar the construction worker must use both hands to attend to applying and tightening the wire tie about the rebar bars.

The use of the plastic tie fastener process improves the manufacturing process because it reduces the time of installation and cost of manpower when compared to using and installing the metal wire ties and spring steel wire clips. In addition, the need for specially coated or stainless steel wires is eliminated because plastic wire tie fasteners are inherently non-corrosive.

The steel reinforced concrete 14 end product is also improved by use of the plastic tie fastener process. Over time, metal tie wires or spring steel wire clips which are near the surface of the steel reinforced concrete will either "bleed" rust or create a dark "bloom" on the surface of the concrete. Plastic tie fasteners simply do not create any such marks.

The plastic tie fastener process produced unexpected results in that they were not expected to meet the strength requirements of securing rebar. The standard of the concrete industry is to use metal ties since plastic is widely believed to be too weak to perform the function of securing rebar. Further, the advantages achieved by use of this invention and process where not expected by the reinforced concrete industry.

The inventor further notes that the invention and method disclosed herein are not limited to securing steel or metal rebar in a reinforced concrete structure. It is understood that the rebar 10 could be composed of any material used to reinforce concrete structures 14. Such materials include, but are not limited to any metal or alloy, plastic, glass, polymers, reinforced woven materials, wood, composite materials, etc. Also, the rebar 10 is not limited to having a bar shape. The inventor anticipates that the rebar material 10 could be a vast variety of geometric shapes including but not limited to squares, triangles, octagons, notched structures, spiral structures, pipes, I-beams, etc. The purpose of the rebar is, at least, to reinforce the concrete.

Although a few preferred embodiments of the invention and method have been shown and described, it will be appreciated by those skilled in the art that changes may be made in these embodiments without departing from the principles and the spirit of the invention.

What is claimed is:

1. A method for manufacturing reinforced concrete comprising the steps of:

forming reinforcing material into an organized structure;

securing said reinforcing material with a plastic tie fastener or a fiber reinforced plastic tie fastener by looping the tie fastener about the reinforcing material and tightening the tie fastener by applying a unidirectional force thereto;

building a mold about said organized structure;

pouring concrete into said mold;

allowing said concrete to set; and removing said mold.

2. The method of claim 1, wherein said reinforcing material is rebar.

3. The method of claim 1, wherein said tie fastener comprises a slip restraint means which is used in the securing step.

4. The method of claim 1, wherein said organized structure is at least one of a grid and a lattice.

5. The method of claim 1, wherein said tie fastener comprises a polymer.

6. The method of claim 1, wherein said tie fastener is a composite of flexible materials.

7. The method of claim 1, wherein the step of securing includes a step of tightening said tie fastener by pulling a first end of said tie fastener in one direction.

8. A method for manufacturing reinforced concrete comprising the steps of:

forming rebar material into an organized structure;

securing said rebar material with a plastic tie fastener or a fiber reinforced plastic tie fastener by looping the tie fastener about the reinforcing material and tightening the tie fastener by applying a unidirectional force thereto, said tie fastener having a slip restraint mechanism;

building a mold about said organized structure; and pouring concrete into said mold.

9. The method for manufacturing reinforced concrete of claim 8, further comprising the steps of:

allowing said concrete to set; and removing said mold.

10. The method for manufacturing reinforced concrete of claim 8, wherein said tie fastener is made of a polymer.

11. The method for manufacturing reinforced concrete of claim 8, wherein said tie fastener does not rust.

12. A method for manufacturing a standing reinforced concrete structure comprising the steps of:

positioning a plurality of rebar bars into an organized upright structure wherein at least a first rebar bar crosses a second rebar bar;

securing said first rebar bar and said second rebar bar to each other with a plastic tie fastener where said first rebar crosses said second rebar, said plastic tie fastener forming a single loop about said first and second rebar bars and being designed to zip in a ratcheted manner so that the single loop tightens about said first and second rebar bars upon applying a unidirectional force thereto;

pouring concrete over said upright structure; and allowing said concrete to set.

13. The method for manufacturing a standing reinforced concrete structure of claim 12, wherein said step of securing includes the step of pulling one end of said plastic tie fastener.

* * * * *